United States Patent [19]

Ross

[11] 4,327,837

[45] May 4, 1982

[54] HANGING RACK

[76] Inventor: Paul C. Ross, 7776 Via Rosa Maria, Burbank, Calif. 91504

[21] Appl. No.: 178,876

[22] Filed: Aug. 18, 1980

[51] Int. Cl.[3] ..... A47F 5/08

[52] U.S. Cl. ..... 211/87; 24/31 V; 24/306; 211/96

[58] Field of Search ..... 211/87, 13, 96, 168; 24/204, 306, 31 V; 248/205 R; 16/124, DIG. 13; 312/123

[56] References Cited

U.S. PATENT DOCUMENTS

| | | | |
|---|---|---|---|
| 1,236,266 | 8/1917 | Chaikis | 211/96 |
| 2,724,510 | 11/1955 | Williams | 211/96 X |
| 3,387,341 | 6/1968 | Mates et al. | 24/306 |
| 3,638,284 | 2/1972 | Baker | 24/306 |
| 3,679,530 | 7/1972 | Perina | 24/306 X |
| 3,718,260 | 2/1973 | Sharp | 211/13 |
| 4,208,841 | 6/1980 | Starks | 24/204 |

FOREIGN PATENT DOCUMENTS

| | | | |
|---|---|---|---|
| 2008543 | 6/1979 | United Kingdom | 211/81 |

*Primary Examiner*—Roy D. Frazier
*Assistant Examiner*—Robert W. Gibson, Jr.
*Attorney, Agent, or Firm*—Richard H. Zaitlen

[57] ABSTRACT

A hanging rack device for hanging articles such as neck ties and belts having a base on which is disposed an attachment means such as the hooked material of a hook and burr-type fastener and one or more hanging means for holding said article which can be secured at any position on said attachment means by virtue of a pile material on the surface thereof which is cooperative with said hooked material thus allowing the articles to be hung in any convenient configuration desired.

6 Claims, 4 Drawing Figures

HANGING RACK

BACKGROUND OF THE INVENTION

1. Field of the Invention

This invention relates to hanging racks for hanging articles such as neck ties and belts, and more particularly, to an improved design thereof.

2. Prior Art

There are a wide variety of hanging racks currently available for hanging such articles as ties, scarves, and belts. However, there are a number of disadvantages inherent in their design. Among these disadvantages is the fact that that the loops or bars upon which the articles are hung are permanently affixed to the base portion of the rack. Thus, the tie or other article must be removed from the rack by unthreading it from the loop, a procedure which frequently involves moving about a number of other ties. This is time consuming and can even result in damage to the ties.

There is also a space consideration. It is desirable to have as many ties in as small a space possible while retaining ease of access and visibility. With prior art racks, the loops or rods for the ties are disposed either in a single horizontal row, one loop next to the other, or in several vertical columns. With just the horizontal row, there is not a good utilization of the available space.

With the racks wherein the loops or bars are disposed in vertical columns, two problems arise. First, there is an overlapping of ties such that the ties beneath the upper ties, will not be readily visible. Second, also due to the overlapping of ties, it is difficult to remove the ties which are beneath the top ties. It is frequently necessary to move the top ties aside in some way in order to get at the ties beneath them. This is a definite inconvenience. In addition, it frequently occurs that the ties or other articles fall off the loops by themselves, as a result of being pushed about or when one attempts to remove them or replace them.

Another disadvantage inherent in all prior art racks is that the loops or bars for hanging the ties are permanently affixed in pre-set positions. Thus, it is impossible to arrange the loops or bars in a configuration more suitable to the user.

BRIEF SUMMARY OF THE INVENTION

It is therefore an object of this invention to provide a design for a hanging rack for articles such as belts and ties wherein the loops upon which the articles are hung are individually removable and positionable for the convenience of the user.

The hanging rack of the present invention generally comprises a base upon which are disposed one or more strips of material comprising a plurality of small hook-like projections. These projections comprise one element of a hook and burr-type fastener. There are also provided a plurality of hanging loops, the outer surface of which comprises the complementary pile surface of the hook and burr-type fastener which may be attached to one of the strips on the base. These loops may be placed at any point desired along any of the strips, thus providing a hanging loop for a tie or a belt or other article at that point.

Also, since the individual loops are removable from the base a specific article may be easily removed from the tie rack by disengaging the loop upon which the article is hung from the attachment strip and then removing the article from the loop itself. The ends of the loops are held closed by conventional fastener means such as a snap so that the loops may be opened up by disengagment of the fastener means, thereby allowing easy removal of the article from the loop.

One benefit of the design described above is that the hanging loops may be disposed on the base in any desired configuration, thus allowing the articles to be staggered and avoiding having articles placed on top completely overlapping articles beneath them. This results in two advantages. First, all of the hanging articles are readily visible without the necessity of pushing top ones aside to see those underneath. Second, the articles underneath others are much easier to gain access to for removal without similarly pushing others aside. Also, as the loops themselves are removable from the tie rack, it is much easier to remove the desired article from the tie rack without the necessity of moving adjacent articles.

The novel features which are believed to be characteristic of the invention, both as to its configuration and method of operation, together with further objectives and advantages thereof, will be better understood from the following description considered in connection with the accompanying drawings in which a presently preferred embodiment of the invention is illustrated by way of example. It is to be presently understood, however, that the drawings are for the purpose of illustration and description only, and are not intended as a definition of the limits of the invention.

DETAILED DESCRIPTION OF THE PREFERRED EMBODIMENT

Figure 1:
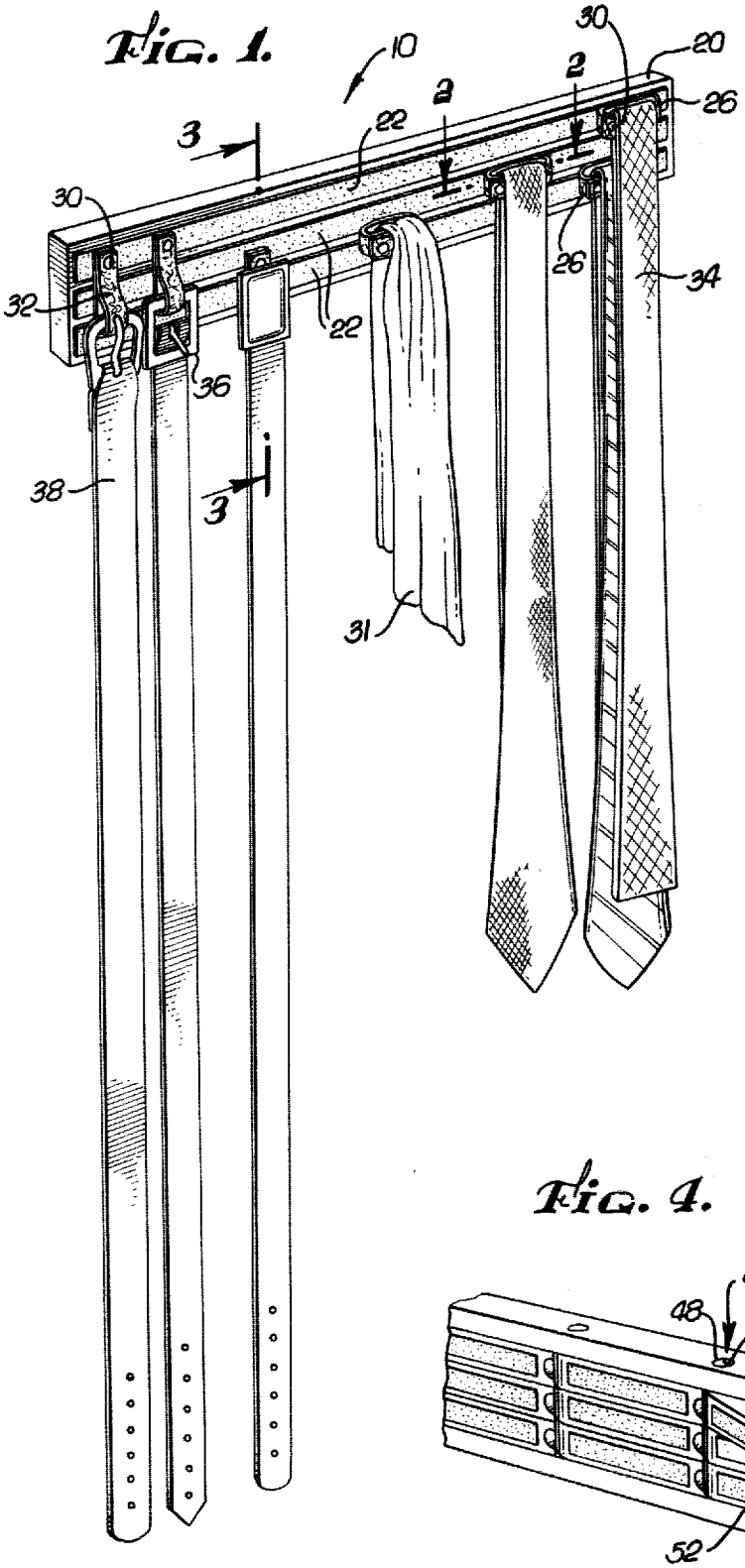
FIG. 1 is a perspective view of the hanging rack device of the present invention.
Figure 2:
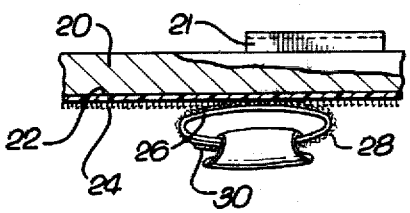
FIG. 2 is a cross-sectional view of the hanging rack device of the present invention taken along line 2—2 of FIG. 1.
Figure 3:
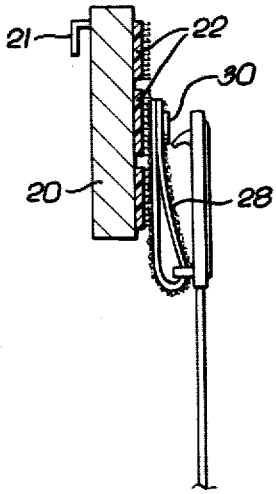
FIG. 3 is a cross-sectional view of the hanging rack device of the present invention taken along line 3—3 of FIG. 1.

Referring to FIGS. 1, 2, and 3, there is shown a presently preferred embodiment of the hanging rack device 10 of the present invention. The hanging rack device 10 is designed to hold a number of articles such as neck ties and belts.

The device 10 has a base 20. In the preferred embodiment, this base 20 is shown as being generally rectangular. Of course, other convenient shapes and configurations are possible while remaining within the scope of the present invention. The base 20 may be made of wood, plastic, metal or any such rigid material. This base 20 is designed to be secured to a wall or a door or some other convenient location where one wishes to store such articles by hook means 21 or by screws or other conventional means.

Disposed on one surface of the base 20 are one or more attachment strips 22. The preferred embodiment shows three attachment strips 22 disposed lengthwise on the surface of the base 20 each being generally parallel to the other two. The attachment strips 22 may be configured in a variety of ways without departing from the scope of the present invention. For example, there could be a plurality of strips disposed vertically as opposed to horizontally as shown in FIG. 1. Also, the entire surface of the base 20 could be covered with one solid attachment strip.

On the outer surface of said attachment strips 22 is a hooked surface 24 comprising a plurality of small hook-shape projections designed to secure to a cooperative pile surface. Such a hook and pile attachment means is generally referred to in the art as a hook and burr-type fastener. When pressed together, the hooked surface 24 and the loops in the pile of the opposite closure element engage creating an adjustable, highly versatile and secure closure. For opening, the elements are simply peeled apart.

The attachment strips 22 may be secured to the base 20 by any of a number of conventional means such as glue or staples. Also metal brads, such as brass, may also be used which will also act as decoration.

There are also provided one or more tie loops 26. Said tie loops 26 comprise a generally reactangular strip of flexible material with a pile surface 28 on at least part of the surface of one side thereof. Said pile 28 surface cooperates with the hooked surface 24 as described above. The side with the pile surface 28 at one end of the tie loop 26 is secured to the opposing side at the opposite end of the tie loop 26 by conventional fastening means 30 to form a generally circular configuration as shown in FIG. 2 with the pile surface 28 facing outwardly. The tie loop 26 may be secured to the base 20 by means of pressing the pile surface 28 against the hooked surface 24 at any at any point desired along one of the attachment strips 22 on the base 20.

Similar to the tie loops 26 there are also provided one or more belt loops 32. The belt loops 32 differ from the tie loops 26 only in that the ends with the surfaces which do not have the pile surface 28 are joined together by conventional fastening means 30. Thus, the belt loops 32 are formed in a shape of a teardrop as shown in FIG. 3 as opposed to the circular configuration of the tie loops 26. Of course, either loop could be used to hang either type object or another object such as a scarf 31.

The conventional fastening means 30 used to secure the ends of the tie loops 26 and the belt loops 32 may be any conventional means which may be fastened and unfastened such as a snap closure. Of course, other closure means are anticipated to be within the scope of the present invention.

In operation, in order to hang a tie 34 on the hanging rack device 10 one need merely loop the tie 34 through the tie loop 26 (or encircle the tie 34 with the tie loop 26 by closing the loop 26 about the tie 34 with the fastening means 30) and then press the tie loop 26 against one or more of the attachment strips 22 such that the hooked surface 24 on the 35 strip 22 and the pile surface 28 on the tie loop 26 engage one another. The tie loop 26 may be secured to the base 20 at any point on the surface with the attachment strips 22 such as solely on one strip 22 or overlapping onto two adjacent strips, etc. Thus, one may position a number of ties 34 anywhere on the hanging rack device 10 where there is disposed a hooked surface 24. In this way, one may avoid the crowding problems inherent in the prior art devices. As one can see in FIG. 1, the ties 34 need not be disposed directly above one another but may be staggered for ease of visibility and access.

When one wishes to remove the tie 34 from the device 10 one need merely pull the tie loop 26 away from the attachment strip 22. The pile surface 28 will then disengage from the hooked surface 24. The fastening means 30 can then be disengaged, allowing the tie loop 26 to be opened up and the tie 34 to be removed. The empty tie loop 26 can be replaced on one of the attachment strips 22 for easy storage.

The operation with respect to belts is similar. The fastening means 30 on the belt loop 32 is first opened. The buckle 36 or any part thereof, i.e., any place on loop or where holder can pass through on the belt 38 is then threaded with the belt loop 32. The fastening means 30 is then closed about the buckle 36 and the belt loop 32 may be secured at any point on the attachment strips 22 desired. Thus, the belt loop 32 may be used on any type belt 38 with a suitable opening and the belt 38 need not have a buckle. In order to remove the belt 38 one need merely reverse the above steps.

Of course, although the operation of the present invention has been described only with respect to ties and belts, it is equally adaptable to any other similar device one wishes to hang from such a rack such as neck chains.

Figure 4:
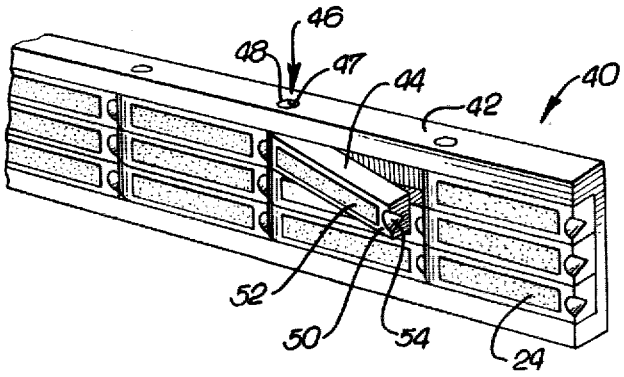
FIG. 4 is a perspective view of an alternate embodiment of the hanging rack device of the present invention.

Referring next to FIG. 4, there is illustrated an alternate embodiment 40 of the hanging rack device 10 of the present invention. The alternate embodiment 40 also has a base 42. Said base 42 is generally C-shaped in cross-section. Within the indentation of said base 42 are disposed a plurality of pivoting members 44 disposed such that each may pivot outward from said base 42. Said pivoting members 44 are each secured to said base 42 at one end by a pivot means 46.

In the embodiment shown, the pivoting members 44 are disposed in columns of three in said base 42. The pivot means 46 comprises a rod 47 which extends through the ends of said pivoting members 44 and each column and is secured by insertion into holes 48 in said base 42. Of course, it is possible to have any number of pivoting members 44 in each column just as it is possible to use any conventional pivot means for securing them to the base 42.

When said pivoting member 44 is in the closed position, there is one surface thereof exposed. On said exposed surface 50 is disposed an attachment strip 52. The attachment strip has a hooked surface 24 similar to that described above with respect to the preferred embodiment. There is also provided at the unsecured end of each pivoting member 44 an indentation 54 into which a finger may be placed so that the pivoting member 44 may be grasped and pivoted outwardly from said base 42.

The operation of the alternate embodiment 40 is identical to that of the preferred embodiment of the device 10. The added feature of the alternate embodiment is that the individual attachment strips 52 on the printing members 44 may be pivoted outwardly from the base 42 thus allowing easier access to the articles hung on the lower strips. The articles on the upper strips which would otherwise hinder access to the lower strips may thus be pivoted away therefrom.

Both the preferred embodiment and the alternate embodiment provide the advantage that one may dispose the tie loops 26 and the belt loops 32 in any configuration desired, thus avoiding the problem of overcrowding and the necessity of having to move about adjacent articles while trying to gain access to a specific article. Also, the loops themselves may be easily removed from the device 10 thus allowing easy access to individual articles rather than having to thread the article out of a loop while it is encumbered by the proximity of other articles.

While a wide variety of materials, shapes and other configurations can be used in this invention, it should be understood that changes can be made without departing from the spirit or scope thereof. This invention, therefore, is not be limited to this specific embodiment discussed and illustrated herein.

I claim:

1. A hanging rack device comprising:

a generally elongated base;

at least one means for hanging articles such as neck ties and belts, said hanging means comprising a closed loop of flexible material with an outer surface which is at least partially covered with a pile surface for engaging hooked projections on an attachment means, said hanging means further including a fastening means for permitting said closed loop of flexible material to be selectively opened; and attachment means fixedly secured to said base for detachably securing said hanging means, said attachment means comprising one or more strips of material containing hooked projections for selectively engaging said pile surface on said hanging means.

2. A device according to claim 1 wherein said loop of flexible material is configured to securably receive an article such as a neck tie or a belt in a hanging relationship.

3. A device according to claim 1 wherein said base has a generally rectangular cross-section.

4. A hanging rack device comprising:

a base;

at least one pivoting member attached to said base at one end of said member such that each member is pivotable away from said base;

means for hanging articles such as neck ties and belts; and at least one attachment means for detachably securing said hanging means to said base, each of said attachment means being disposed on the surface facing away from said base of each said pivoting member and comprising a strip of material containing hooked projections for selectively engaging a pile surface.

5. A device according to claim 4 wherein said pivoting members have indentations at the free end of said member opposite to the end which is attached to said base, such that said free end may be grasped and forced away from said base.

6. A device according to claim 4 wherein each said hanging means comprises a loop of flexible material with an outer surface which is at least partially covered with a pile surface for engaging said hooked projections.

* * * * *